US005802985A

United States Patent [19]

Munk et al.

[11] Patent Number: 5,802,985

[45] Date of Patent: Sep. 8, 1998

[54] GUIDES FOR TRANSPORTING PALLETS AND DEVICE FOR MANUFACTURING THE SAME

[75] Inventors: Edmund Munk, Oberstenfeld; Helmuth Huber, Gronau, both of Germany

[73] Assignee: Werzalit AG + Co., Oberstenfeld, Germany

[21] Appl. No.: 523,744

[22] Filed: Sep. 5, 1995

[51] Int. Cl.[6] ..... B65D 19/00

[52] U.S. Cl. ..... 108/51.11; 108/51.3; 108/52.1

[58] Field of Search ..... 108/51.1, 51.3, 108/52.1, 56.3, 901

[56] References Cited

U.S. PATENT DOCUMENTS

| | | | |
|---|---|---|---|
| 4,061,090 | 12/1977 | Callon | 108/51.1 |
| 4,198,912 | 4/1980 | Gramckow | 108/51.1 |
| 4,408,544 | 10/1983 | Haataja | 108/51.1 X |
| 5,255,614 | 10/1993 | Voss-Schrader et al. | 108/51.3 X |
| 5,425,314 | 6/1995 | MacFarland | 108/51.3 |

FOREIGN PATENT DOCUMENTS

| | | | |
|---|---|---|---|
| 2303124 | 1/1973 | Germany . | |
| 2733213 | 2/1979 | Germany | 108/52.1 |
| 1593083 | 7/1981 | United Kingdom | 108/52.1 |

*Primary Examiner*—Jose V. Chen
*Attorney, Agent, or Firm*—Michael J. Striker

[57] ABSTRACT

A guide for supporting transporting pallets and to be located between the legs of the transporting pallet has a one-piece integral body composed of fibers with a heat-hardenable binder, and both end parts of the body have a density which is greater than a density of the central part. The high density of the end parts can be provided by narrowings formed in the region of the end parts and extending either at one side or at both sides of the longitudinal axis of the body. A device for making the guide is formed to increase density of the end parts of the guide.

1 Claim, 3 Drawing Sheets

2
2'
1
3
2
2

2'
1
3
2

2

5
5
4
3
5

5

5
4
5

GUIDES FOR TRANSPORTING PALLETS AND DEVICE FOR MANUFACTURING THE SAME

BACKGROUND OF THE INVENTION

The present invention relates to guides for transporting pallets which are provided with feet.

More particularly, it relates to such guides for transporting pallets which are arranged parallel to a main longitudinal axis of the transporting pallet between its feet.

The invention also relates to devices for manufacturing of such guides.

Transporting pallets with guides are known in the art, for example from German patent document DE-C-23 03 124. The guides are provided for example for improving stacking of the loaded transported pallets, since the guides increase the placing surfaces of the transporting pallets and prevent damages by the transporting pallet to the loaded product in the stack by the transporting pallet located under the same. The transporting pallets provided with the guides are frequently received during their use by floor transporting devices. It is not excluded that the forks of the floor transporting devices abut against the ends of the guides and can damage the same. Attempts have been made to provide the end sides of the guides with a protection formed for example as a cap of synthetic plastic material of an inserted web of hard wood. These known solutions are reliable as to their action. However, they require additional features to provide structural components and to mount the same.

SUMMARY OF THE INVENTION

Accordingly, it is an object of the present invention to provide guides for transporting pallets and a device for their manufacture, which avoids the disadvantages of the prior art.

More particularly, it is an object of the present invention to provide a guide for transporting pallets in which the protection of its end sides must not be applied subsequently after the manufacture, but is available immediately from the very beginning.

In keeping with these objects and with others which will become apparent hereinafter, one feature of the present invention resides, briefly stated, in that the guide is pressed from a mixture of fibers and a heat hardenable binder as a one-piece element, and the ends of the guide are provided with a higher density than a remaining longitudinal portion of the guides.

When the guides are provided with a higher density at their ends, they obtain a higher resistance against mechanical loading by abutments or impacts and therefore are better protected from damages.

In accordance with another feature of the present invention, the guides are provided with a one-side narrowing at their ends.

Still another feature of the present invention resides in the fact that the guides can be provided with narrowings at both ends of the same.

In accordance with the present invention, also a new device for producing the guides is provided. The new device includes a press which has a pressing tool lower part including a stationary central part and a frame which surrounds the central part and is liftable and lowerable, a pressing tool upper part formed as a flat plate, and a central part having a substantially flat upper surface and provided in the vicinity of the frame with continuously increasing raised portions.

With the device described hereinabove, the guides in accordance with the present invention can be produced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1A, 1B, 1C, 2A, 2B, 2C:
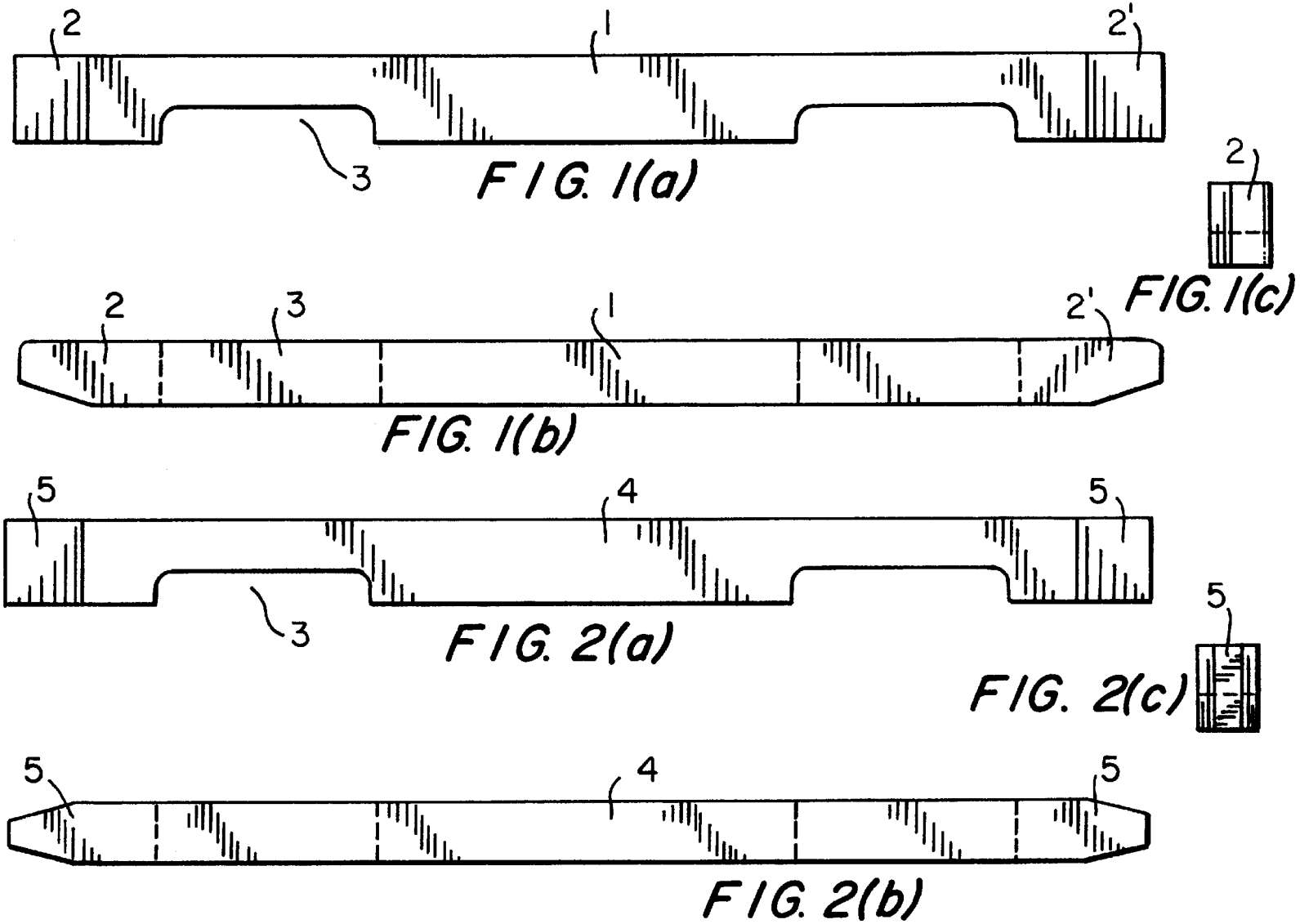
FIGS. 1*a*, 1*b* and 1*c* are a side view, a plan view and a front view of a guide for transporting pallets in accordance with the present invention.
FIGS. 2*a*, 2*b* and 2*c* are view substantially corresponding to the views of FIGS. 1*a*, 1*b*, and 1*c*, but showing another embodiment of the guide in accordance with the present invention.

A guide for transporting pallets in accordance with a first embodiment of the invention is shown in FIGS. 1*a*, 1*b* and 1*c* and has a main part which is identified as a whole with reference numeral 1. At opposite ends of the main part 1 as considered in the longitudinal direction, end parts 2, 2' are provided. The end parts 2 have 2' a higher density the main part 1. This higher density can be achieved by providing a narrowing on each of the ends of the guide or more particularly in each of the end parts 2 and 2'. The main part 1 of the guide is provided at a lower side with several recesses 3. The recesses 3 form a space for lateral insertion of forks of floor transporting devices.

A guide for transporting pallets shown in FIGS. 2*a*, 2*b* and 2*c* has generally a similar construction to guide shown in FIGS. 1*a*, 1*b*, 1*c*. The guide of FIGS. 2*a*, 2*b*, 2*c* also has a main part which is identified with reference numeral 4. The guide also has the end parts which are identified with reference numerals 5 and 5'. In contrast to the end parts 2 and 2' of FIGS. 1*a*, 1*b*, 1*c*, the end parts 5 and 5' of the second embodiment are formed as narrowings which narrow at both sides of the guide as considered as the plan view. In other words, each end part 5, 5' narrows on the plan view from both sides in a transverse direction of the guide.

The guides are produced by pressing from a mixture of fibers and a heat-hardenable binder so as to form a one-piece integral element. The chip or fiber forming mixture can be for example a not flowable mixture of comminuted lignocellulose-containing particles, such as comminuted and dried wood chips, bagasse fibers, etc. which are admixed to a heat-hardenable binder having a thermosetting basis such as a melamine-ureaformaldehyde or phenolformaldehyde resin. Instead of the comminuted and dried wood or bagasse fibers, also fibers of other materials can be utilized such as for example glass fibers or stone wall alone, or several fibers of different materials can be mixed together, and added to a corresponding for example organic binder.

Figure 3:
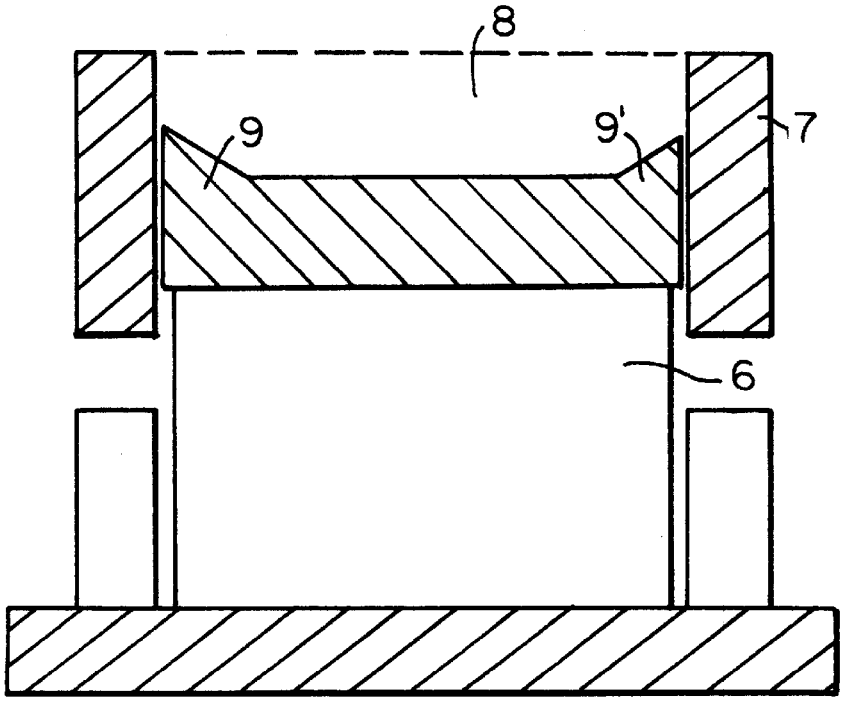
FIG. 3 is a view showing a pressing tool upper part of a device for producing the inventive guide of FIG. 1 in accordance with the present invention.
Figure 4:
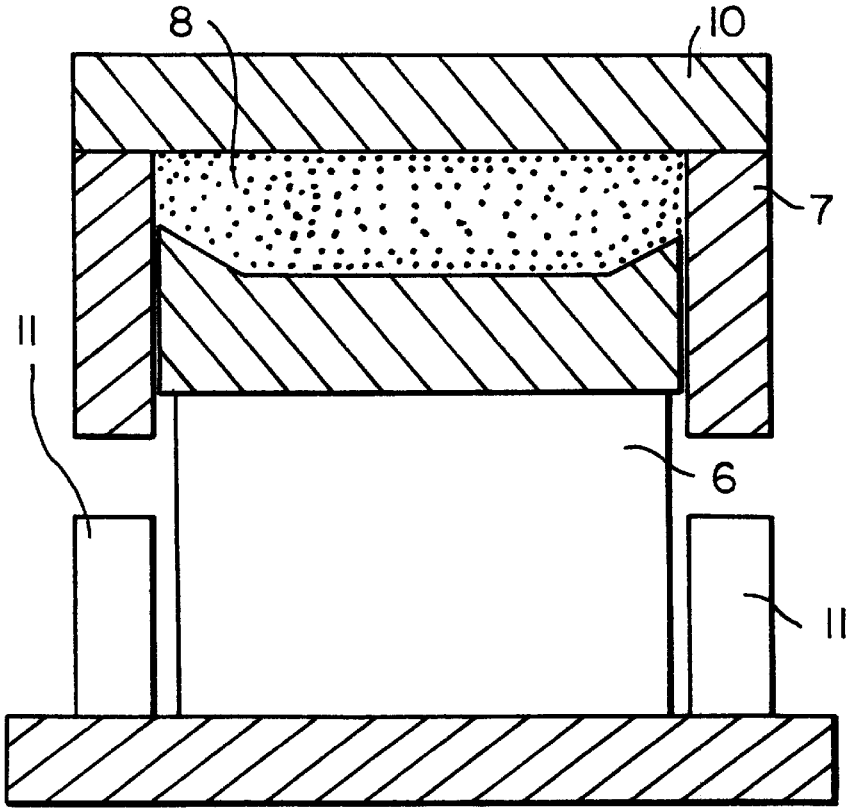
FIG. 4 is a view showing a pressing tool lower part of FIG. 3 with a paced pressing tool upper part.
Figure 5:
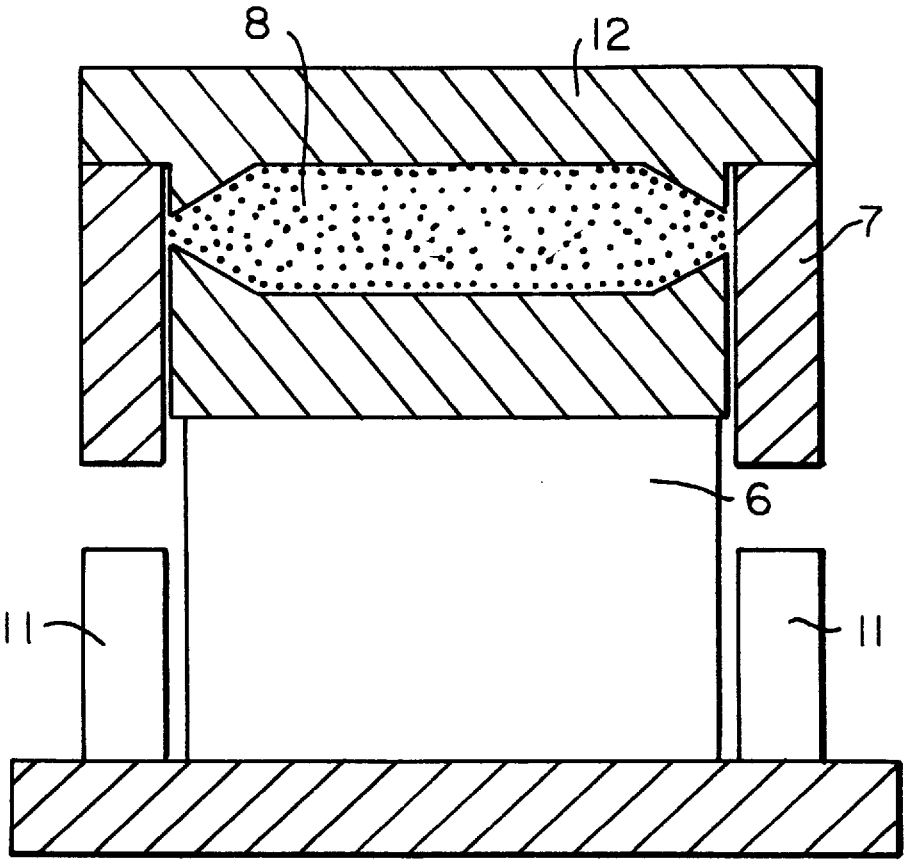
FIG. 5 is a view showing a pressing tool for producing the guide of FIG. 2 in accordance with the present invention.

FIGS. 3–5 show a pressing tool for producing the guide in accordance with the present invention. The pressing tool has a lower part suitable for producing the guides of both embodiments. The lower part has a stationary central element 6 surrounded by a liftable and lowerable frame 7. The frame 7 is displaced for example by a spring force to the upper position shown in FIG. 3, so that the central part 6 and the frame 7 together form a filling space 8. A mixture for manufacturing the guides of the shown embodiments is filled in the filling space 8. The upper surface of the central part 6 is substantially flat over its greater part. However, near the frame 7 it is provided with raised portions 9 and 9'. This is the region where a higher density must be obtained in the guide.

FIG. 4 shows the press with a placed pressing tool upper part 10. the upper part has the shape of a flat plate. The mixture is filled in the filling space 8 as shown by dots. Then the force is applied to the upper part 10, the upper part 10 of the pressing tool moves together with the frame 7 downwardly until the frame 7 is seated on the support 11. The mixture in the filling space 8 is compacted so that in the region of the raised portions 9 and 9' it is compressed more than in the remaining regions. Thereby a solid profiled body is produced from the compressed mixture, and the compressed mixture is subjected to corresponding temperatures so as to harden the binder in the mixture.

FIG. 5 shows a press for pressing the guides shown in FIGS. 2*a*, 2*b*, 2*c*. In this press an upper part 12 of the pressing tool is different from the upper part of the pressing tool of FIG. 4. In particular, the lower surface of the upper part 12 which faces the upper surface of the central part 6 is provided with raised portions 13 and 13' in the regions near the frame 7. When the upper part is designed in accordance with these features with the raised portions 13 and 13', the guide pressed in the filling chamber 8 from the mixture is provided with the end parts 5 and 5' which have narrowings at both sides.

It will be understood that each of the elements described above, or two or more together, may also find a useful application in other types of methods and constructions differing from the types described above.

While the invention has been illustrated and described as embodied in guides for transporting pallets and device for manufacturing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A guide for arranging between feet of transporting pallets, comprising a one-piece integral elongated body composed of a mixture of fibers and a heat hardenable binder, said body having a central part and two end parts as considered in a longitudinal direction, said central part and said end parts being composed of a same material, but the material of said end parts being compressed more the material of said central part, so that said end parts have a density which is higher than a density of said central part.

* * * * *